US008347417B1

(12) United States Patent
Chur

(10) Patent No.: US 8,347,417 B1
(45) Date of Patent: Jan. 8, 2013

(54) POCKET HANDKERCHIEF SUPPORT DEVICE

(76) Inventor: ILsung R. Chur, San Jose, CA (US)

( * ) Notice: Subject to any disclaimer, the term of this patent is extended or adjusted under 35 U.S.C. 154(b) by 424 days.

(21) Appl. No.: 12/802,352

(22) Filed: Jun. 4, 2010

(51) Int. Cl.
*A41B 15/00* (2006.01)
*A41D 31/00* (2006.01)

(52) U.S. Cl. ..... 2/279; 2/243.1

(58) Field of Classification Search ..... 2/279, 244, 2/243.1, 69, 1; D2/501, 503, 508; 24/3.5, 24/3.1, 3.9, 11 CT; 206/37; 224/932; 248/905; 211/13.1, 85.3, 16
See application file for complete search history.

(56) References Cited

U.S. PATENT DOCUMENTS

| | | | | | |
|---|---|---|---|---|---|
| 1,631,398 | A | * | 6/1927 | Campbell | 2/279 |
| 2,163,710 | A | * | 6/1939 | Schockling | 24/3.5 |
| 2,211,023 | A | * | 8/1940 | Murphy | 24/3.5 |
| 2,269,511 | A | * | 1/1942 | Biederman | 2/279 |
| 2,495,012 | A | * | 1/1950 | Kugler | 24/3.1 |
| 2,551,184 | A | * | 5/1951 | Valenti | 2/279 |
| 2,597,146 | A | * | 5/1952 | Ginal, Jr. | 2/279 |
| 2,738,515 | A | * | 3/1956 | Owen | 2/279 |
| 2,777,133 | A | * | 1/1957 | Phillips, Jr. | 2/279 |
| 2,964,811 | A | * | 12/1960 | Loehnert | 24/3.12 |
| 2,968,045 | A | * | 1/1961 | Johnson | 2/279 |
| 3,072,917 | A | * | 1/1963 | Watson, Jr. | 2/279 |
| 3,135,967 | A | | 6/1964 | Stephens | |
| 3,144,894 | A | * | 8/1964 | Young | 150/134 |
| 3,412,435 | A | * | 11/1968 | Poppe | 24/3.7 |
| 3,514,790 | A | * | 6/1970 | Harvey | 2/279 |
| 3,786,520 | A | * | 1/1974 | Harmon | 2/279 |
| 3,947,925 | A | * | 4/1976 | Hargrave, Jr. | 24/3.5 |
| 5,231,702 | A | * | 8/1993 | Masters | 2/244 |
| 5,253,370 | A | | 10/1993 | Mead | |
| 5,353,481 | A | * | 10/1994 | Farris, Jr. | 24/545 |
| 6,412,118 | B1 | | 7/2002 | Shanklin | |
| 7,107,627 | B2 | | 9/2006 | Holland | |
| D600,427 | S | * | 9/2009 | Hernandez | D2/501 |
| D600,890 | S | * | 9/2009 | Groves | D2/860 |
| 2005/0144705 | A1 | * | 7/2005 | Holland | 2/279 |
| 2007/0113323 | A1 | * | 5/2007 | Groves | 2/279 |

* cited by examiner

*Primary Examiner* — Amber Anderson
(74) *Attorney, Agent, or Firm* — Salter IP Law; Jim H. Salter

(57) ABSTRACT

Various embodiments provide a pocket handkerchief support device. An example embodiment includes: a main support having a plurality of elastic straps attached thereto for holding a handkerchief firmly against a front surface of the main support, the main support including nubs at a lower end, the nubs creating a void in a recessed lower edge of the main support; and an extender attachment including an adhesive area on an upper portion of the extender attachment for removably attaching the extender attachment to the main support, the extender attachment including nubs at a lower end, the nubs creating a void in a recessed lower edge of the main support.

9 Claims, 4 Drawing Sheets

POCKET HANDKERCHIEF SUPPORT DEVICE

TECHNICAL FIELD

The disclosed subject matter relates to the field of apparel devices, and particularly to handkerchief or pocket devices.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2009-2010 Paul Chur, All Rights Reserved.

BACKGROUND

The use of handkerchiefs to adorn the pocket of a dress suit is familiar to those who observe fashion trends. Stylish dressers are known to coordinate a necktie with a matching handkerchief, for example, where the handkerchief is extended from a suit breast pocket such as to be visible.

Arranging the handkerchief to achieve the desired presentation is often difficult. The handkerchief may not be large enough to stick out of the breast pocket and folding the handkerchief may be cumbersome as well. Another problem with some garments with pockets has been that a handkerchief inserted into the pocket does not maintain its shape and height in the pocket as positioned. Over time, the handkerchief loses its shape and height and is no longer flattering or disappears inside of the pocket altogether. Conventional devices to assist in presenting the handkerchief have not provided a satisfactory remedy for the disheveled and disappearing handkerchief in the chest pocket.

U.S. Pat. No. 7,107,627 describes a handkerchief valet, which is a removable pouch utilized for the purpose of inserting and holding in place, a handkerchief folded as desired, to be placed in the upper left side exterior chest pocket (chest pocket) of a suit coat or sports jacket. However, the pouch can be bulky and may cause the pocket to undesirably protrude.

U.S. Pat. No. 6,412,118 describes a pocket handkerchief, which is woven entirely of fabric and stitched such that an ornamental part of the handkerchief is visible when deposited in the pocket. The pocket handkerchief may be useful as a handkerchief, when needed. After use, the pocket handkerchief may be returned to the pocket and thereafter maintain its stylish quality. However, the described pocket handkerchief cannot be adjusted to conveniently fit a variety of depths of pockets.

U.S. Pat. No. 5,253,370 describes a dual purpose adjustable base for mounting prefolded "pocket silk" hankerchiefs. The device has a unibody base formed by joining two sections of leatherette. However, the dual purpose device can also be bulky and may cause the pocket to undesirably protrude.

U.S. Pat. No. 3,135,967 describes a handkerchief holder, and particularly a holder adapted to hold a full size handkerchief in proper position in the upper pocket of men's suit coats, waitresses' uniforms, and other garments while the handkerchief is folded into the particular shape desired by the wearer. However, the described handkerchief holder does not include a recessed lower edge to provide space for excess portions of the handkerchief and to keep the handkerchief holder in proper position.

Thus, a pocket handkerchief support device is needed.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is described and claimed a pocket handkerchief support device.

Figure 1:
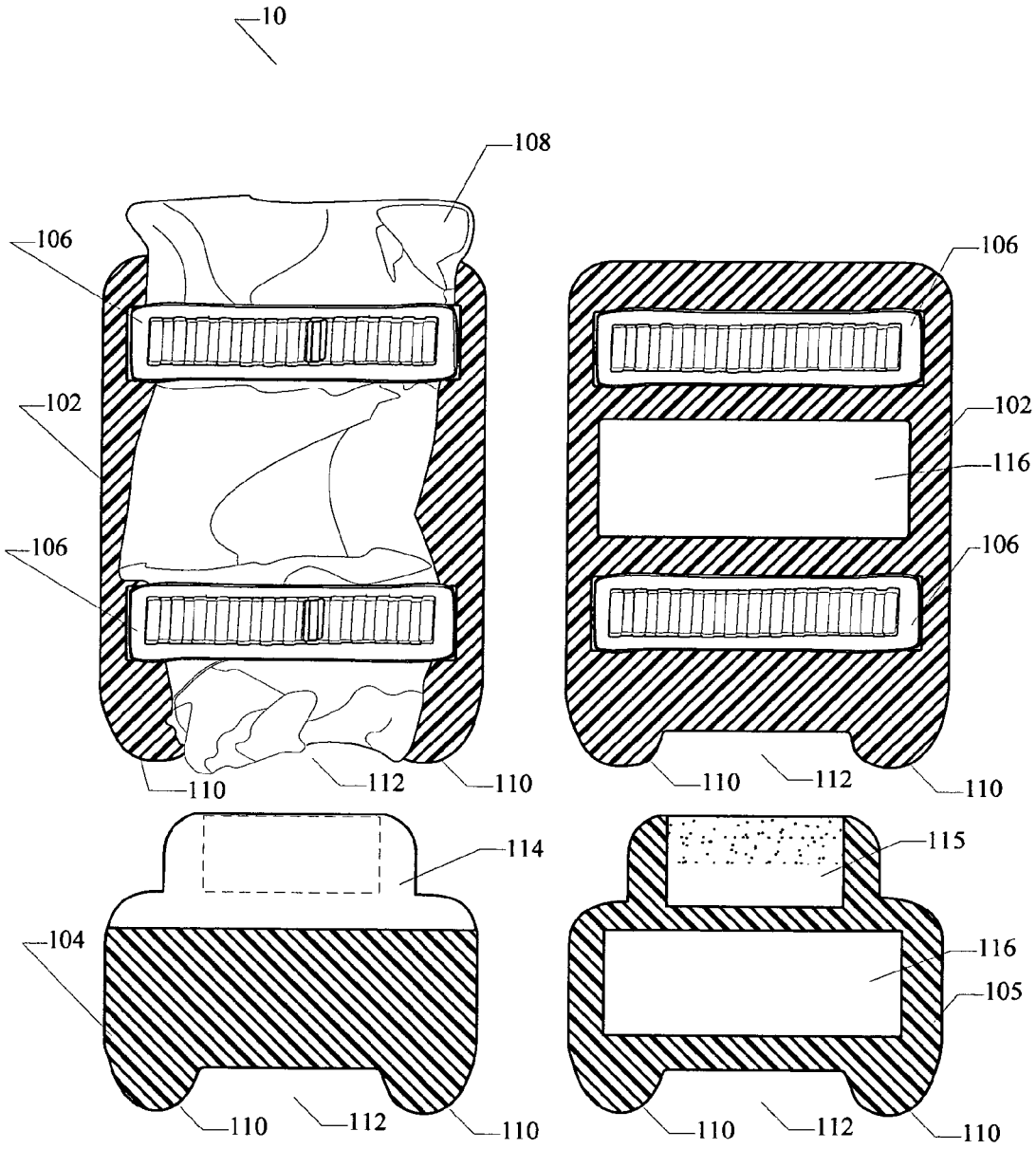
FIG. 1 illustrates a front/top view of an example embodiment of the pocket handkerchief support device with an extender attachment detached.

Referring now to FIG. 1, FIG. 1 illustrates a front/top view of an example embodiment of the pocket handkerchief support device 10 with an extender attachment detached. The example embodiment of the pocket handkerchief support device 100 includes a main support 102 fabricated from any of a variety of rigid materials, such as plastic, cardboard, wood, leather, metal, or other light-weight rigid materials. The main support 102 is generally rectangular, with a thin or low-profile thickness, and fabricated of dimensions slightly smaller than the dimensions of an average breast pocket of a suit jacket, tuxedo jacket, blazer, or other garment having a pocket within which a handkerchief is typically worn. As such, the main support 102 can be easily inserted into the pocket of a garment; yet, the main support 102 does not slide, shift, or become skewed within the pocket as the garment is worn. Additionally, the low-profile thickness of main support 102 prevents the main support 102 from becoming too bulky and causing the pocket to undesirably protrude.

As shown in FIG. 1, the main support 102 includes nubs (protuberances) 110 at the lower end of main support 102. Nubs 110 provide a void 112 at the lower end of main support 102. As the main support 102 is inserted into a pocket, the nubs 110 make contact with the bottom of the pocket and preserve the void 112 within the pocket. The void 112 provides a recessed lower edge of main support 102 thereby providing space for excess portions of a handkerchief and keeping the main support 102 in proper position within the pocket.

As also shown in FIG. 1, the main support 102 includes straps 106 designed to hold a handkerchief 108 firmly against a front surface of the main support 102. The straps 106 can be elastic fabric straps, such as those shown in FIG. 1. The elasticity and width of the straps 106 provide contraction strength and an ample surface for securely holding the handkerchief 108 against the front surface of the main support 102. As shown in the example embodiment of FIG. 1, two straps 106 can be provided on main support 102 to securely hold the handkerchief 108 and prevent the handkerchief 108 from slipping or becoming skewed relative to the main support 102 and a pocket into which the main support 102 is inserted with the handkerchief 108 attached. The ends of straps 106 can be attached to main support 102 with staples, glue, or other common attachment mechanism. Alternatively, the ends of straps 106 can be inserted into holes formed in the main support 102 and joined together to form a loop. The straps 106 can be alternatively fabricated from rubber bands, elastic strips, hook and loop (e.g., Velcro brand) strips, or the like. The surface of the straps 106 in contact with the handkerchief 108 can also be formed with a friction-producing texture to more firmly hold the handkerchief 108 against main support 103 without slippage. As shown in FIG. 1, nubs 110 create a void 112 that provides a recessed lower edge of main support 102 thereby providing space for excess portions of handkerchief 108. In this manner, the nubs 110 enable the main support 102 to remain in the proper position within the pocket. Any excess portions of handkerchief 108 can be tucked through void 112 and restrained by the straps 106 on the back side of the main support 102. FIG. 1 illustrates an example embodiment of the pocket handkerchief support device 10 with and without a handkerchief 108 tucked into straps 106 of main support 102.

Note that the main support 102, shown in the example embodiment of FIG. 1, looks the same on both sides. Thus, the view of main support 102, shown in the example embodiment of FIG. 1, appears the same as a view of the reverse side of the main support 102. Because the ends of straps 106 can be inserted into holes formed in the main support 102 and joined together to form a loop, the straps 106 are present on both sides of the main support 102. As such, the main support 102 is reversible and functions in the same manner as described herein when inserted in a pocket with either the front side or the back side of the main support 102 facing the body of a garment wearer. Similarly, the straps 106 can securely hold the handkerchief 108 against either the front surface or the back surface of the main support 102. The reversibility of the main support provides a convenient, adaptable, and universal pocket handkerchief support device.

Referring still to FIG. 1, the example embodiment of the pocket handkerchief support device 10 is shown to include an extender attachment 104 or 105. Some garment pockets are deeper than other pockets. If a particular pocket is too deep and a main support 102 is too short, the handkerchief support device 10 with a handkerchief 108 tucked into straps 106 would undesirably descend too deeply into the pocket and handkerchief 108 would become obscured. To correct this situation, various embodiments include an extender attachment 104 or 105 to effectively extend the length/height of the main support 102 and thereby prevent the handkerchief support device 10 from descending too deeply into the pocket. As described in more detail below, the extender attachment 104 or 105 can be removably attached to a surface of main support 102. FIG. 1 illustrates a front/top view of an example embodiment of the pocket handkerchief support device 10 with the extender attachment 104/105 detached.

Similar to the main support 102, the extender attachment 104/105 can be fabricated from any of a variety of rigid materials, such as plastic, cardboard, wood, leather, metal, or other light-weight rigid materials. The extender attachment 104/105 is generally rectangular, with a thin or low-profile thickness, and fabricated of dimensions generally smaller than the dimensions of the main support 102. The extender attachment 104/105 includes the same nubs (protuberances) 110 at the lower end of extender attachment 104/105. As with the main support 102, nubs 110 provide a void 112 at the lower end of extender attachment 104/105. As nubs 110 make contact with the bottom of a pocket, the void 112 is retained within the pocket. The void 112 provides a recessed lower edge of extender attachment 104/105 thereby providing space for excess portions of a handkerchief and keeping the main support 102 and extender attachment 104/105 in proper position within the pocket.

Figure 2:
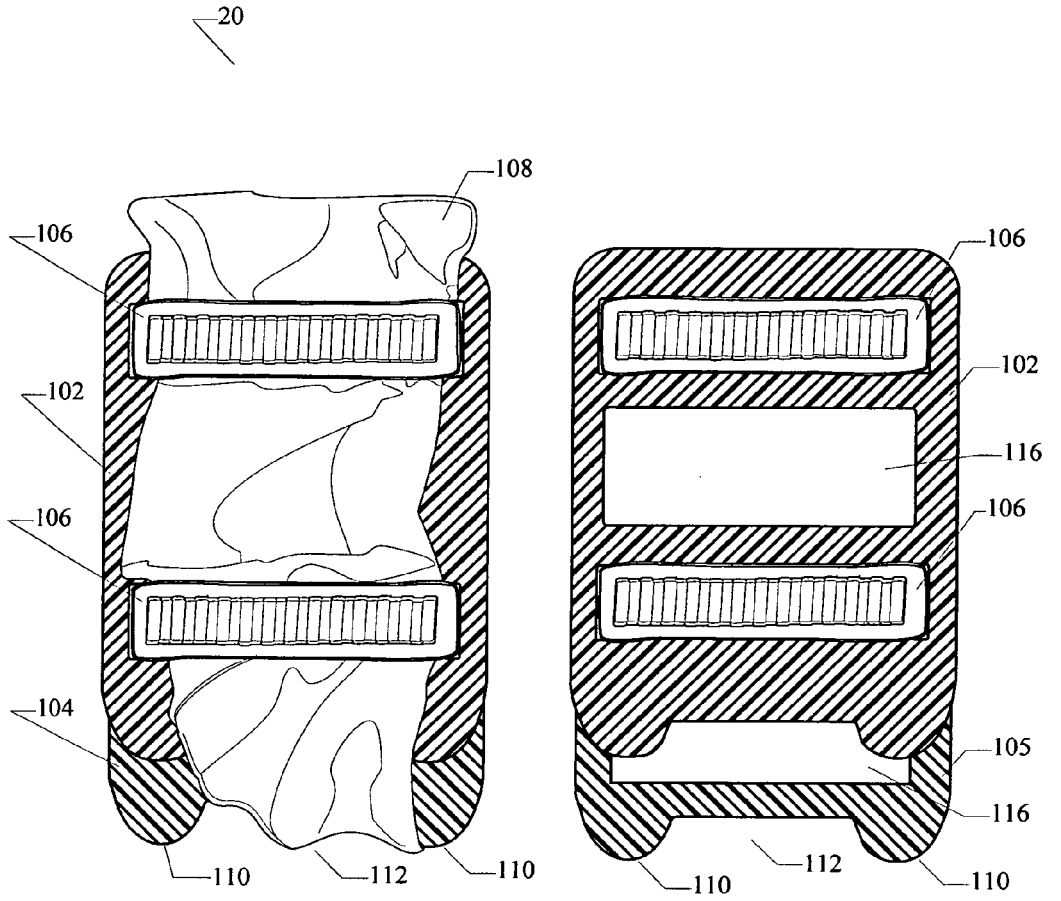
FIG. 2 illustrates a front/top view of an example embodiment of the pocket handkerchief support device with an extender attachment attached.

As shown in FIG. 1, a surface 114/115 on the upper portion of extender attachment 104/105 provides an adhesive or hook and loop (e.g., Velcro brand) attachment mechanism with which the extender attachment 104/105 can be attached to a back side of the main support 102 as shown in FIG. 2. The attachment of the extender attachment 104/105 to the main support 102 serves to extend the overall length of the pocket handkerchief support device 20 to fit better into deeper pockets. The overall length of the pocket handkerchief support device 20 can be adjusted by attaching the extender attachment 104/105 higher or lower on the back of the main support 102. In one embodiment shown in FIG. 1, extender attachment 104 is shown to include a large adhesive area 114 on the upper portion of extender attachment 104. The adhesive used on area 114 can be any of a variety of adhesive compounds that retain their adhesive qualities after many cycles of attachment and detachment. Alternatively, another embodiment of the extender attachment 105 is shown in FIG. 1 to include adhesive area 115 on the upper portion of extender attachment 105. The adhesive area 115 can be a hook and loop (e.g. Velcro brand) patch, a hook, or other mechanism for attaching the extender attachment 105 to a back side of the main support 102. It will be apparent to those of ordinary skill in the art in view of this disclosure that a variety of alternative adhesive mechanisms can be used to attach extender attachment 104/105 to the main support 102. As shown in FIG. 1, both the main support 102 and the extender attachment 104/105 include an advertising area 116 on which an advertisement, logo, image, or other commercial content can be displayed.

FIG. 2 illustrates a front/top view of an example embodiment of the pocket handkerchief support device 20 with the extender attachment 104/105 attached. FIG. 2 also illustrates how a handkerchief 108 can be tucked under the straps 106 with the excess portion of handkerchief 108 wrapped through the void 112, around extender attachment 104 and secured on the back side of main support 102 by straps 106. In this manner, the handkerchief 108 can be securely held in place by the pocket handkerchief support device 20 with an extended length to fit properly in a deeper pocket.

Figure 3:
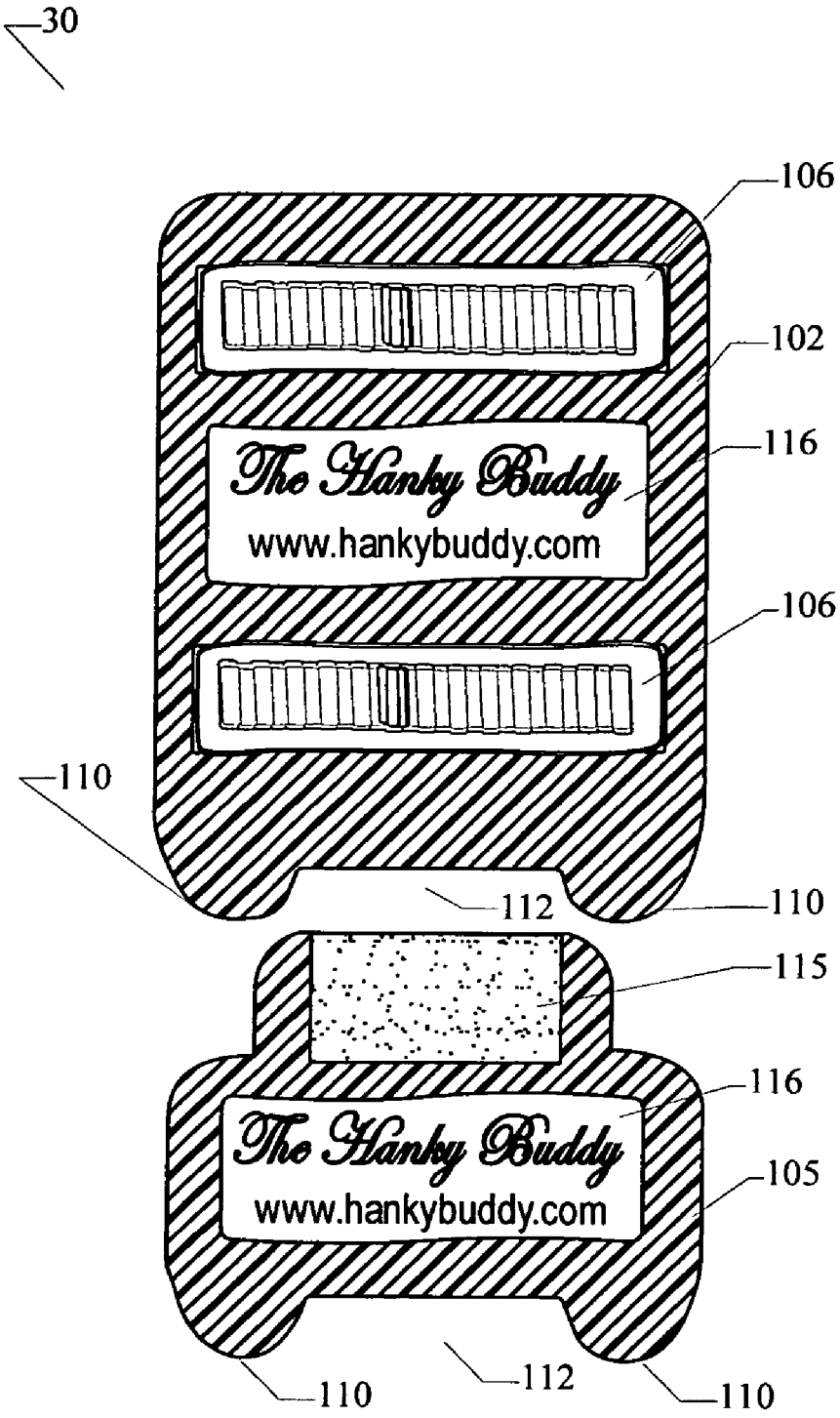
FIG. 3 illustrates a back/rear view of an example embodiment of the pocket handkerchief support device with an extender attachment detached.

FIG. 3 illustrates a back/rear view of an example embodiment of the pocket handkerchief support device 30 with the extender attachment 105 detached. In the embodiment shown in FIG. 3, the advertising area 116 includes a display of commercial content. It will be apparent to those of ordinary skill in the art in view of this disclosure that a variety of advertising or commercial content can be displayed in advertising area 116 of either main support 102 and/or the extender attachment 104/105.

Figure 4:
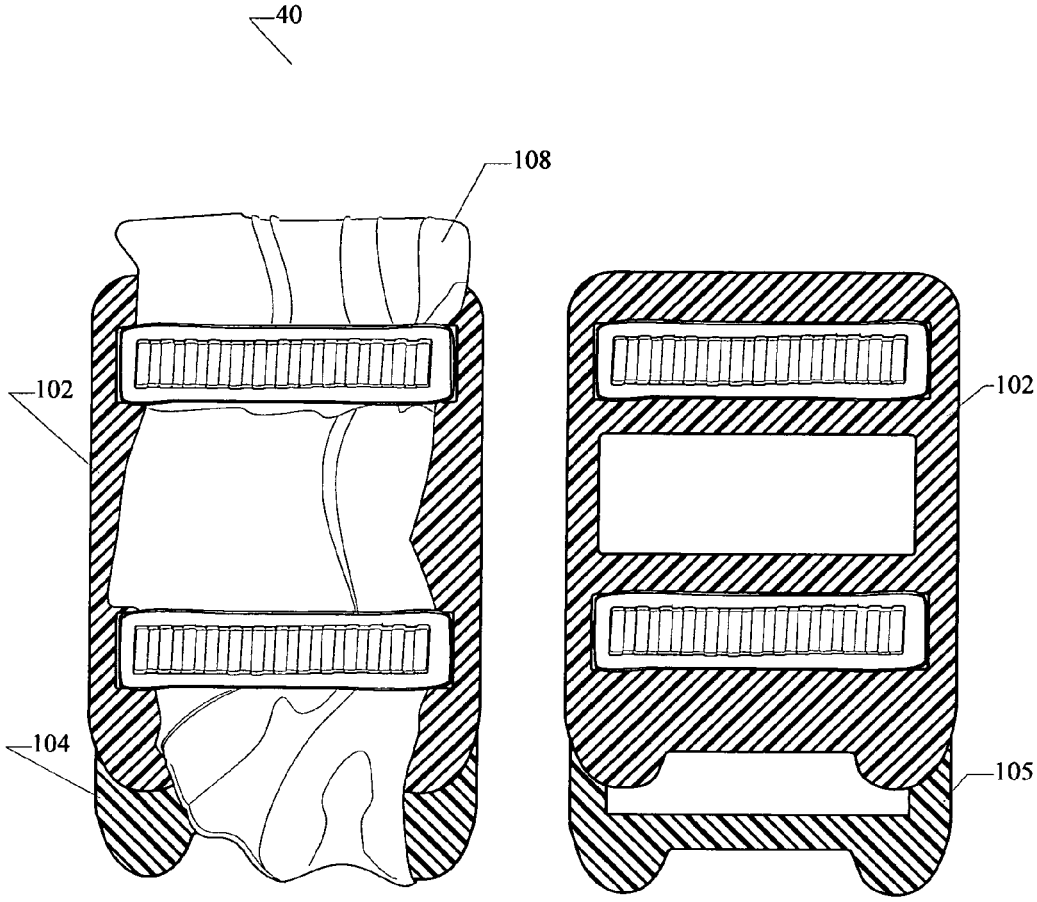
FIG. 4 illustrates a front/top view of an example embodiment of the pocket handkerchief support device with an extender attachment attached and the handkerchief folded in an alternate manner.

FIG. 4 illustrates a front/top view of an example embodiment of the pocket handkerchief support device 40 with an extender attachment attached and the handkerchief 108 folded in an alternate manner. By comparing the arrangement of the handkerchief 108 in FIGS. 1 and 2 with the handkerchief 108 in FIG. 4, it can be seen that the handkerchief 108 can be folded in an alternate manner. In fact, the handkerchief 108 can be folded in any of a variety of ways given that the straps 106 serve to securely hold the handkerchief 108 securely in place no matter how the handkerchief is folded. By folding handkerchief 108 in any of a variety of ways, a variety of different design images can be presented as the pocket handkerchief support device 40 is used in the pocket of a garment.

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to comply with 37 C.F.R. §1.74(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus the following claims are hereby incorporated into the Detailed Description, with each claim standing on its own as a separate embodiment.

Thus, as described above, a pocket handkerchief support device is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

I claim:

1. A pocket handkerchief support device comprising:

a main support having a plurality of elastic straps attached thereto for holding a handkerchief firmly against a front surface of the main support, the main support including nubs at a lower end, a recess created between the nubs in a lower edge of the main support; and an extender attachment including an adhesive area on an upper portion of the extender attachment for removably attaching the extender attachment to the main support, the extender attachment including nubs at a lower end, a recess created between the nubs in a lower edge of the extender attachment.

2. The pocket handkerchief support device as claimed in claim 1 wherein the main support and the extender attachment are fabricated from light-weight rigid materials from the group: plastic, cardboard, wood, leather, and metal.

3. The pocket handkerchief support device as claimed in claim 1 wherein the main support and the extender attachment have a thin or low-profile thickness.

4. The pocket handkerchief support device as claimed in claim 1 wherein the elastic straps are elastic fabric straps.

5. The pocket handkerchief support device as claimed in claim 1 wherein the elastic straps are inserted through holes in the main support.

6. The pocket handkerchief support device as claimed in claim 1 wherein the adhesive area on the upper portion of the extender attachment includes an adhesive compound.

7. The pocket handkerchief support device as claimed in claim 1 wherein the adhesive area on the upper portion of the extender attachment includes a hook and loop patch.

8. The pocket handkerchief support device as claimed in claim 1 wherein the main support and the extender attachment include an advertising area on which commercial content can be displayed.

9. The pocket handkerchief support device as claimed in claim 1 wherein the main support is reversible.

* * * * *